US006393612B1

(12) United States Patent
Thach et al.

(10) Patent No.: US 6,393,612 B1
(45) Date of Patent: May 28, 2002

(54) GARMENT

(75) Inventors: Bradley T. Thach, Kirkwood; Claudia M. Gerard, Webster Groves, both of MO (US)

(73) Assignee: Washington University, St. Louis, MO (US)

( * ) Notice: Subject to any disclaimer, the term of this patent is extended or adjusted under 35 U.S.C. 154(b) by 0 days.

(21) Appl. No.: 09/843,310

(22) Filed: Apr. 26, 2001

(51) Int. Cl.[7] ..... A41B 13/06
(52) U.S. Cl. ..... 2/69.5
(58) Field of Search ..... 2/69.5, 69, 111, 2/83, 73, 75, 80, 88, 89

(56) References Cited

U.S. PATENT DOCUMENTS 965,921 A * 8/1910 Mercey
1,940,224 A * 12/1933 Munro ..... 5/343
2,008,919 A * 7/1935 Milkes ..... 5/343
2,213,754 A * 9/1940 Thirring ..... 280/11.37
2,675,552 A * 4/1954 Jackson ..... 2/69.5
2,676,319 A * 4/1954 Davidson et al. ..... 2/1
2,888,009 A * 5/1959 Taylor ..... 128/134
3,096,759 A * 7/1963 Coolbaugh ..... 128/94
3,739,399 A * 6/1973 Sheahon ..... 2/69.5
4,611,353 A * 9/1986 Als et al. ..... 2/69
4,616,365 A * 10/1986 Lyons ..... 2/69
4,773,101 A * 9/1988 Kapp et al. ..... 2/69.5
4,897,885 A * 2/1990 Lunt ..... 2/69.5
5,016,650 A * 5/1991 Marlar ..... 128/878
5,129,406 A * 7/1992 Magnusen et al. ..... 128/873
5,131,096 A * 7/1992 Olson ..... 2/75
5,293,646 A * 3/1994 Winston ..... 2/88
5,367,709 A * 11/1994 Teasley ..... 2/69
5,412,813 A * 5/1995 Hosley ..... 2/69
6,055,686 A * 5/2000 Knight ..... 5/494

* cited by examiner

*Primary Examiner*—John J. Calvert
*Assistant Examiner*—Alissa L. Hoey
(74) *Attorney, Agent, or Firm*—Senniger, Powers, Leavitt & Roedel

(57) ABSTRACT

A garment for swaddling a baby. The garment includes an elongate shell having an outer surface and an inner surface defining an interior volume for receiving the arms, legs and trunk of a baby therein. The garment also includes a pair of internal restraints positioned inside the interior volume of the shell. Each of the restraints receives one of the arms of the baby to retain the respective arm within the interior volume of the shell.

33 Claims, 4 Drawing Sheets

GARMENT

BACKGROUND OF THE INVENTION

The present invention relates generally to garments for babies, and more particularly to a garment for swaddling a baby.

Conventionally, parents wrap or swaddle babies in one or more sections of cloth or a blanket. It is believed swaddling adds to a baby's comfort by holding a baby tightly, much as a baby would feel in its mother's womb or a parent's arms. By imitating this feeling, a swaddle may act to calm and soothe a baby, helping it to rest more peacefully.

This is especially important for babies having trouble resting comfortably on their backs. Because of the increased risk of Sudden Infant Death Syndrome (SIDS) for babies sleeping on their stomachs, it is desirable to place babies on their back for sleeping. However, when babies have difficulty resting and sleeping on their backs, some parents alter the sleeping position of the baby to its front or side to calm the baby even though this is inadvisable due to an increased risk of SIDS. Swaddling may help babies rest more comfortably on their backs so they are less likely to be placed in an inadvisable sleeping position.

However, swaddling presents potential health risks for babies. First, conventional swaddles are usually constructed from strips of cloth which are wrapping around the baby and tucking inside the swaddle. Over time the swaddle may become loosened as the baby moves within the swaddle, and the baby may become entangled in a loose strip thereby inhibiting its breathing. Second, if a baby frees itself from a swaddle, it may rollover thereby increasing its risk for SIDS. Finally, conventional swaddles wrap around the entire baby including its legs, and hold the legs in an extended position. It is believed the incidence of hip dysplasia increases when the babies legs are tightly swaddled in an extended position because the legs cannot flex or abduct to their natural position within the swaddle.

SUMMARY OF THE INVENTION

Among the several objects and features of the present invention may be noted the provision of a garment which comforts a baby without inhibiting breathing; the provision of a garment which remains in place on the baby; and the provision of a garment which does not adversely inhibit leg movement.

Generally, the present invention includes a garment for swaddling a baby. The garment comprises an elongate shell having an outer surface, and an inner surface opposite the outer surface defining an interior volume for receiving the arms, legs and trunk of a baby therein. The shell has a head end, a foot end opposite the head end, lateral sides extending between the head end and the foot end, and a neck opening at the head end for receiving a neck of the baby. The garment also includes a pair of restraints positioned inside the interior volume of the shell adjacent the lateral sides. Each of the restraints receives one of the arms of the baby to retain the respective arm within the interior volume of the shell.

In another aspect, the shell of the garment includes a body portion adjacent the head end sized and shaped for enclosing the arms and trunk of the baby and for holding the arms of the baby in close proximity to the trunk of the baby. The shell also includes a leg portion adjacent the foot end sized and shaped for enclosing the legs of the baby with sufficient space to permit flexure and abduction of the hips of the baby within the interior volume of the garment.

In yet another aspect of the present invention, the shell has a longitudinal opening extending from the neck opening for providing access to the interior volume of the shell. The longitudinal opening has an open position for inserting the baby into the interior volume and removing the baby from the volume, and a closed position for retaining the baby in the interior volume. Further, the shell has an unstretched circumference measured around the inner surface of the shell when the longitudinal opening is in the closed position between about fifty percent and about 75 percent of a corresponding nominal girth of the baby measured around the trunk and arms of the baby.

In still another aspect, the shell applies a pressure to the baby when the longitudinal opening is in the closed position between about one half centimeter of water and about three centimeters of water.

Further, the present invention includes a method of swaddling a baby comprising the steps of placing a baby in an interior volume of an elastic shell having a longitudinal opening for providing access to the interior volume of the shell, and adjusting a girth of the shell so that when the shell is wrapped taut around the baby without stretching the shell, the longitudinal opening of the shell has a width selected to apply a predetermined approximate pressure to the baby when the longitudinal opening is closed. The method further includes the step of closing the longitudinal opening to stretch the shell around the baby and secure the shell about the baby.

In another aspect, the method comprises the steps of securing each arm of the baby to the shell to retain the respective arm in the interior volume of the shell.

Other objects and features of the present invention will be in part apparent and in part pointed out hereinafter.

BRIEF DESCRIPTION OF THE DRAWINGS

Corresponding parts are designated by corresponding reference numbers throughout the drawings.

DETAILED DESCRIPTION OF THE PREFERRED EMBODIMENTS

Figure 1:
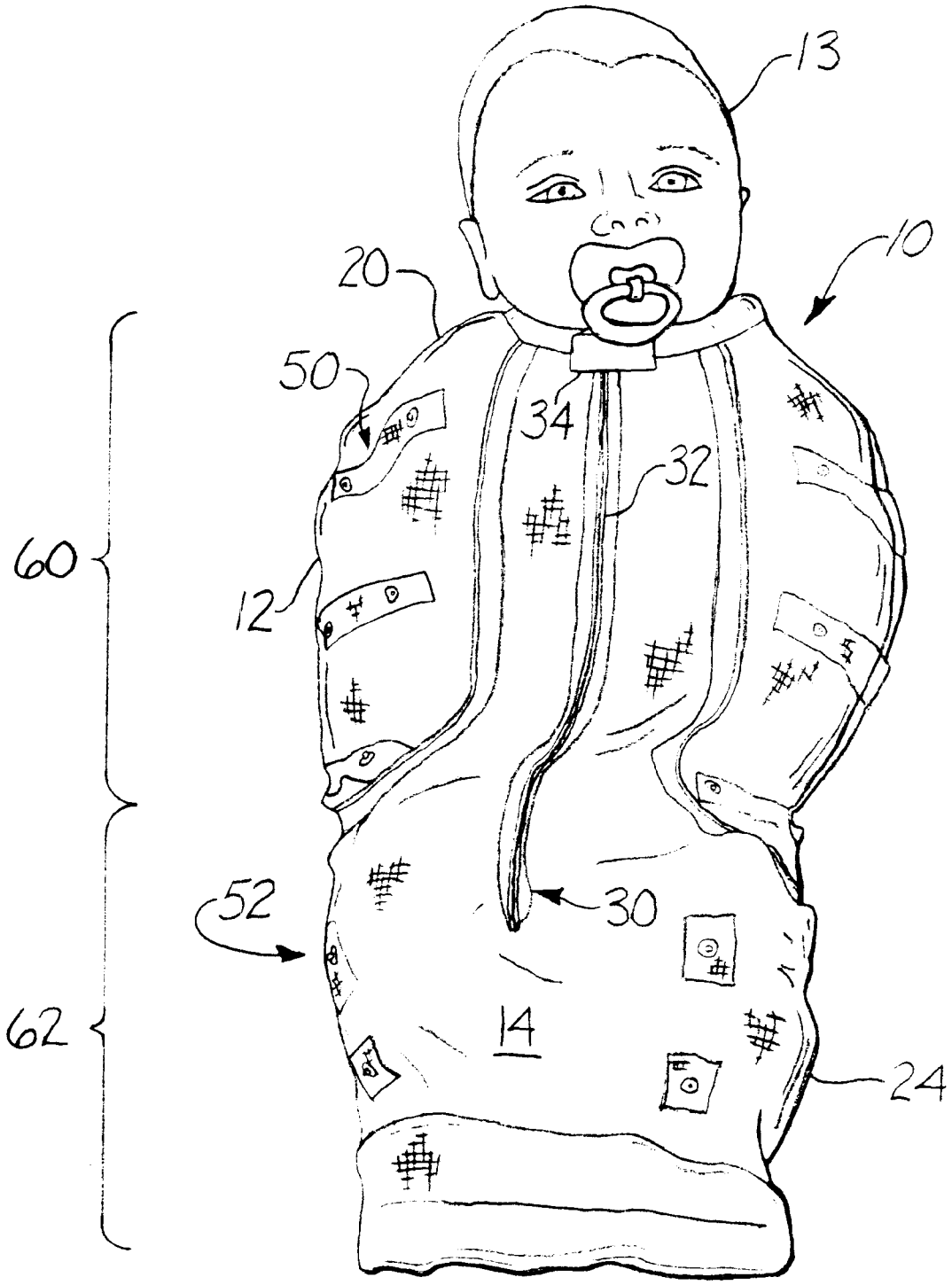
FIG. 1 is a front elevation of a garment of the present invention having a baby therein.
Figure 2:
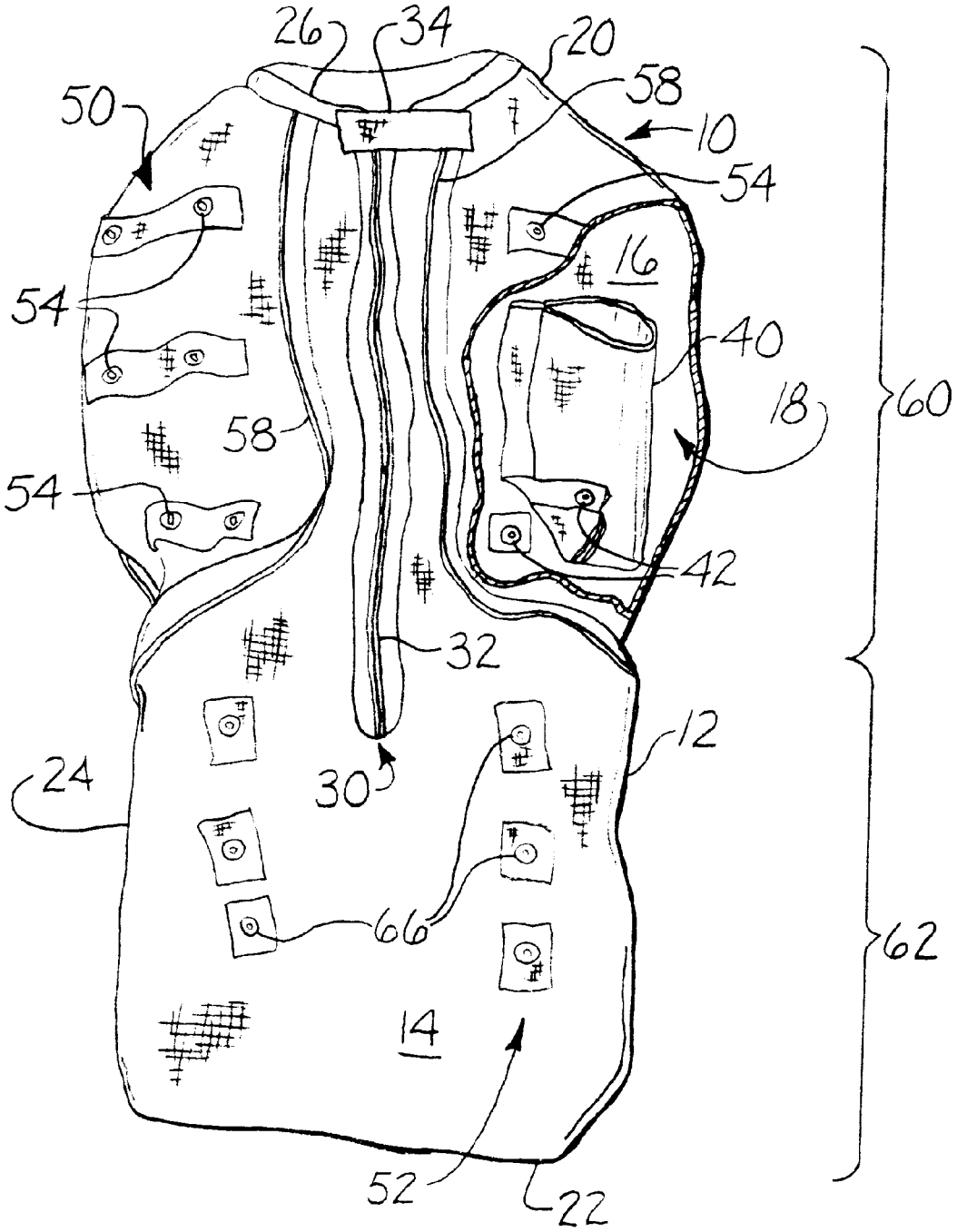
FIG. 2 is a front elevation of the garment in partial section to illustrate interior features thereof.
Figure 3:
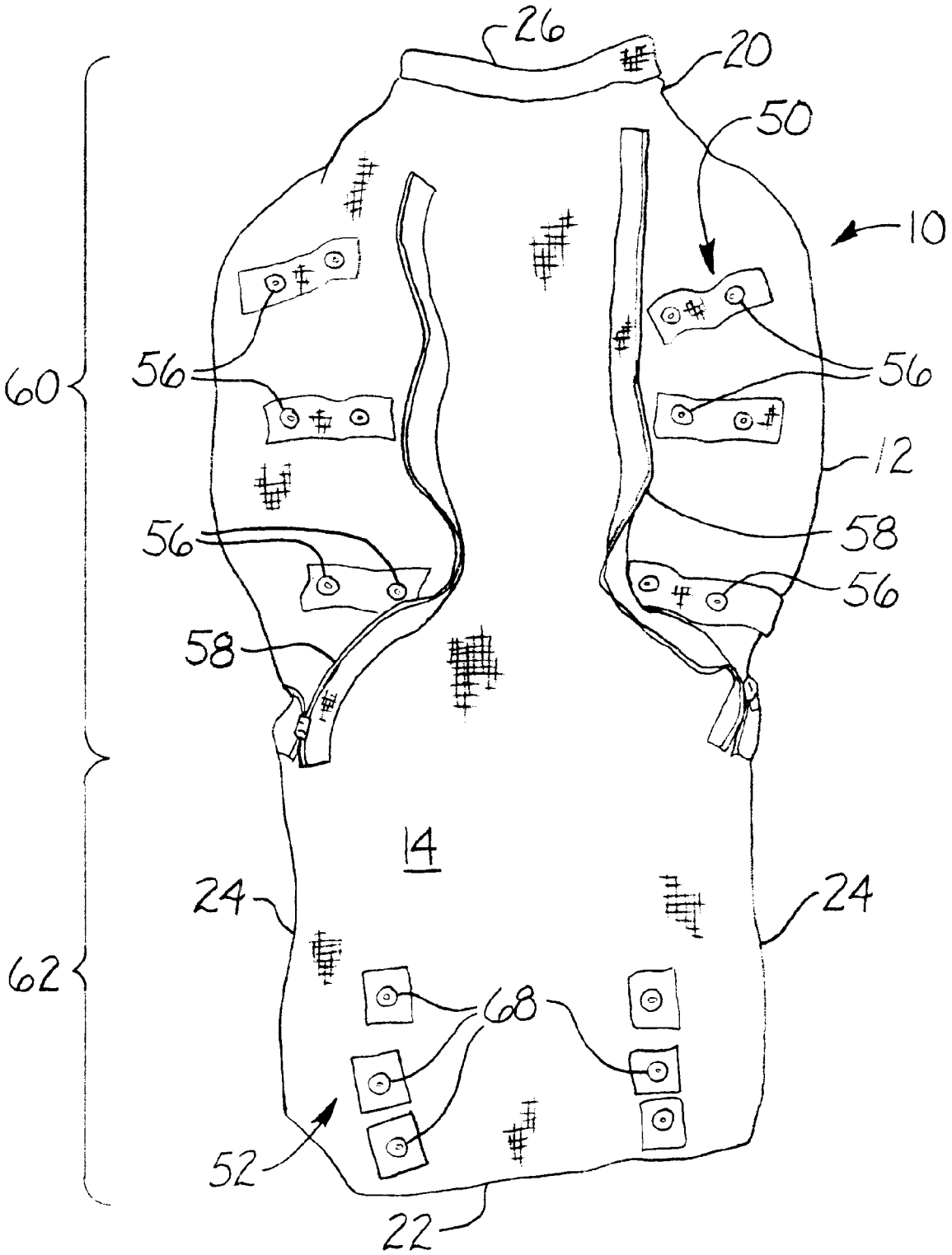
FIG. 3 is a rear elevation of the garment.
Figure 4:
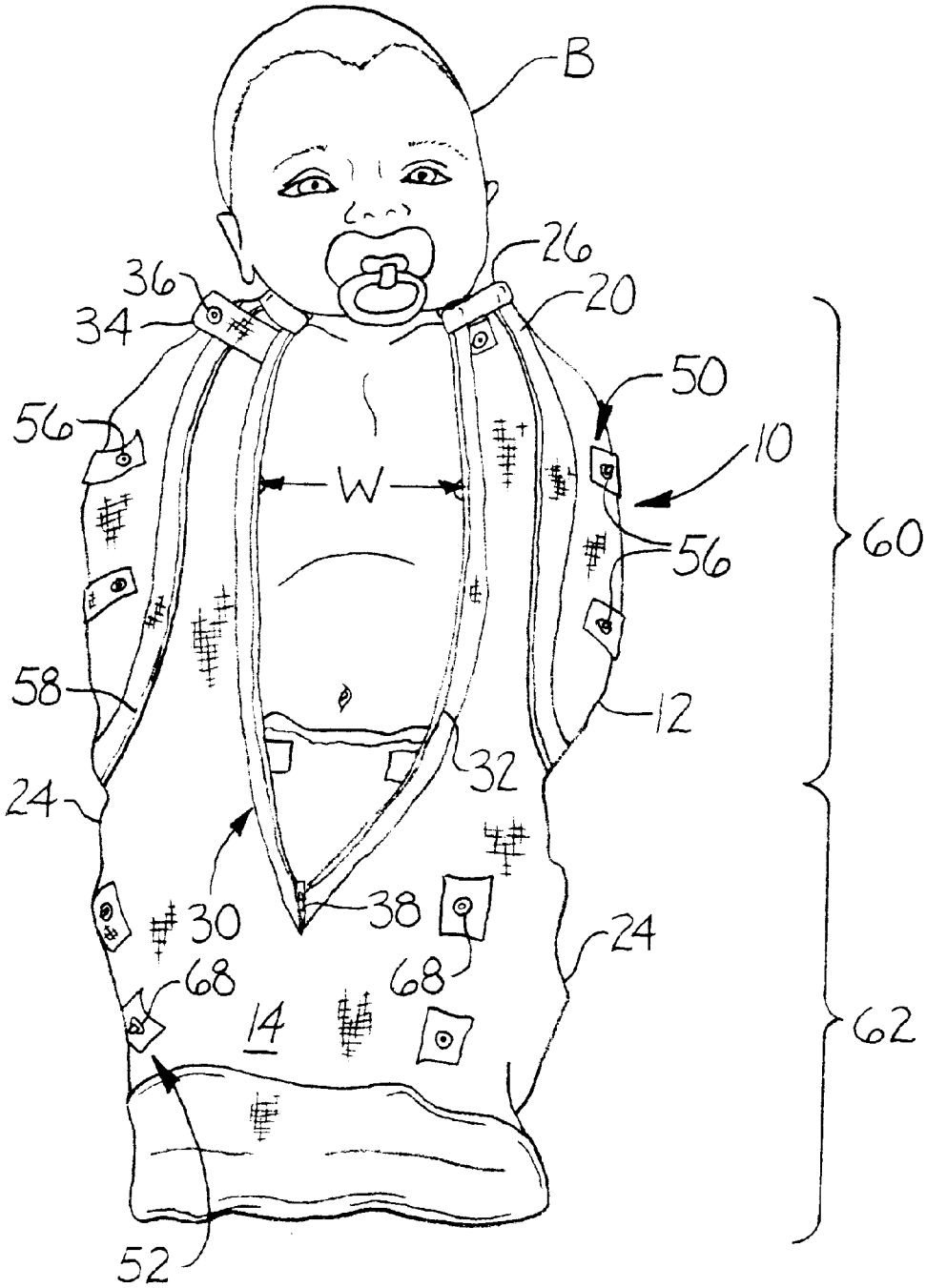
FIG. 4 is a front elevation of the garment with a longitudinal opening in an open position to illustrate proper sizing of the garment.

Referring now to the drawings and in particular to FIGS. 1–3, a garment of the present invention is designated in its entirety by the reference numeral 10. The garment 10 generally comprises an elongate shell 12 having an outer surface 14 and an inner surface 16 (FIG. 2) opposite the outer surface defining an interior volume, generally designated by 18 (FIG. 2), sized and shaped for receiving the arms, legs and trunk of a baby B (FIG. 1). The shell 12 also has a head end 20, a foot end 22 opposite the head end, and lateral sides 24 extending between the head end and the foot end. Further, the shell 12 has a neck opening 26 at the head end 20 for receiving a neck of the baby and a longitudinal opening 28 (FIG. 4) extending from the neck opening for providing access to the interior volume 18 of the shell. The longitudinal opening 28 has an open position as illustrated in FIG. 4 for inserting the baby B into the interior volume 18 and removing the baby from the volume, and a closed position as illustrated in FIG. 1 for retaining the baby in the interior volume. Although the shell 12 may have other dimensions without departing from the scope of the present invention, in one embodiment the shell has an overall length of about twenty inches, a width at the head end 20 of about 11.5 inches, a width at the foot end 22 of about 7.5 inches and a width approximately midway between the head and foot ends of about 11 inches.

A closure, generally designated by 30, is disposed along the longitudinal opening 28 for selectively closing the longitudinal opening and securing the baby B inside the interior volume 18 of the shell 12. Although the longitudinal opening 28 and closure 30 may extend along other faces of the garment 10 without departing from the scope of the present invention, in one embodiment they extend along the front of the garment as shown in FIG. 1. Further, although the closure 30 may have other configurations without departing from the scope of the present invention, in one embodiment the closure includes a conventional zipper 32 and a neck strap 34 adjacent the neck opening 26. The neck strap includes a snap fastener 36 (FIG. 4) for releasably fastening the strap across the longitudinal opening 28 of the garment 10 to cover a zipper pull 38 (FIG. 4) of the zipper 32 when the opening is in the closed position. Other conventional closures (e.g., snaps, Velcro® fasteners, ties and hooks) are also contemplated for closing the longitudinal opening 28 of the shell 12.

As illustrated in FIG. 2, the garment 10 includes a pair of restraints 40 (only one of which is shown) positioned inside the interior volume 18 of the shell 12 adjacent the lateral sides 24. Each restraint 40 is sized and shaped for receiving one of the arms of the baby B to retain the respective arm in the interior volume 18 of the shell. Although it is envisioned that the restraints 40 may have other configurations without departing from the scope of the present invention, in one embodiment each restraint is tubular. Further, it is envisioned that the lower end of each restraint 40 may be open or closed without departing from the scope of the present invention. Still further, it is envisioned that each restraint may be releasably or permanently attached to the inner surface 16 of the shell 12 without departing from the scope of the present invention. In one embodiment, the restraints 40 are fastened to the inner surface 16 of the shell 12 with snap fasteners 42.

As further illustrated in FIG. 2, the garment 10 also includes adjustment elements, generally designated by 50 and 52, disposed along the shell for adjusting the size and/or shape of the interior volume 18 of the shell 12. The adjustment elements 50, 52 allow the garment 10 to be adjusted to fit babies B of differing sizes and shapes and allow the interior volume 18 of the shell 12 to be adjusted to fit a baby as it grows. In one preferred embodiment, the first set of adjustment elements 50 is positioned along the lateral sides 24 of the shell 12 for adjusting a girth of the shell to accommodate babies of differing sizes, and the second set of adjustment elements 52 is positioned at the foot end 22 of the shell for adjusting a length of the shell to accommodate babies of differing lengths.

The first set of adjustment elements 50 comprises several fasteners arranged in longitudinal rows along the lateral sides 24 of the shell 12. Although other fasteners may be used without departing from the scope of the present invention, in one embodiment the fasteners include two rows of male snap fasteners 54 (FIG. 2) arranged on a front of the shell 12, two rows of female snap fasteners 56 (FIG. 3) arranged on a back of the shell. In addition, the adjustment elements 50 may include a zipper 58 extending along each lateral side 24 of the shell 12. The rows of male snap fasteners 54 and female snap fasteners 56 may be snapped together to reduce the size of the shell 12 as illustrated in FIG. 4 to fit a smaller baby B. Similarly, the fasteners 54, 56 may be disengaged to increase the girth of the garment 10 to accommodate babies as they grow. The material between the snapped male and female fasteners 54, 56 may be folded inside the interior volume 18 of the shell 12 before the fasteners are connected. The girth of the interior volume 18 of the shell changes depending on which male and female snap fasteners 54, 56 are connected. For example, the outer-most fasteners 54, 56 on only one side 24 of the shell 12 may be connected to slightly reduce the garment girth, or the inner female fasteners may be connected to the outer male fasteners on both sides of the shell for a greater reduction in girth, or the inner-most fasteners on each side of the shell may be connected for an even greater reduction in girth. Other types of adjustment elements 50 besides snaps and zippers (e.g., Velcro® fasteners, hooks, ties and hooks) are also contemplated as being within the scope of the present invention.

The garment 10 should be snug around the baby's B arms and trunk to provide comfort but be looser around the legs to avoid causing hip dysplasia. The adjustment elements 50 extending along the lateral sides 24 of the shell 12 are only positioned along a body portion 60 of the shell adjacent the head end 20 for covering the arms and trunk of the baby B. A leg portion 62 of the shell 12 adjacent the foot end 22 for covering the legs of the baby B is substantially free of adjustment elements 50 for adjusting the girth of the garment. Consequently, the adjustment element 50 permits the body portion 60 of the shell 12 to be sized and shaped for enclosing the arms and trunk of the baby B and for holding the arms of the baby in close proximity to the trunk of the baby, but ensures the leg portion 62 of the shell is appropriately sized and shaped for providing the legs of the baby with sufficient space to permit the baby to flex and abduct its hips within the interior volume 16 of the garment 10.

The second set of adjustment elements 52 comprises multiple fasteners arranged across the leg portion 62 of the garment 10 to allow the foot end 14 to be rolled and fastened to the shell 12 between the head end 12 and the foot end 14. The adjustment elements 52 preferably include male snap fasteners 66 arranged along the front of the leg portion 62 and female snap fasteners 68 arranged along the back of the leg portion. When none of the snap fasteners are fastened (as shown in FIGS. 2 and 3), the shell 12 is at its maximum length. To shorten the shell, the leg portion 62 is rolled upward (as shown in FIGS. 1 and 4) and the male and female snap fasteners 66, 68, respectively, are connected to secure the leg portion 62 in a shortened position. In one embodiment, the garment includes three pairs of male snap fasteners 66 on the front of the leg portion 62 and three pairs of female snap fasteners 68 on the back of the leg portion, providing three shortened positions and allowing the garment 10 to be adjusted to four different lengths.

The shell 12 of the garment is preferably formed from an elastic material, such as a material comprising spandex fibers. Other materials exhibiting similar characteristics are also contemplated as being within the scope of the present invention. Further, the material used to form the shell 12 is preferably breathable to allow the baby to regulate its temperature without becoming overly hot or cold.

To use the garment 10, the baby B is placed in the interior volume 16 of the elastic shell 12. Each arm of the baby B is slipped into one of the restraints 40 in the shell 12 to thereby secure the arm in the shell and to retain the respective arm in the interior volume 16 of the shell. A girth of the shell 12 is adjusted by fastening the appropriate combination of fasteners 54, 56 so that when the shell is wrapped taut around the baby without stretching the shell, the longitudinal opening 28 of the shell has a width W selected to apply a predetermined approximate pressure to the baby when the longitudinal opening is closed. Preferably, this pressure is as small as needed to calm the baby B. Larger than needed pressures should be avoided to prevent the garment 10 from interfering with breathing. Although other pressures may be used without departing from the scope of the present invention, in one embodiment the approximate pressure is between about one half centimeter of water and about three centimeters of water. Although the width W may be defined in other ways without departing from the scope of the present invention, in one way the width is defined as a distance between two spaced anatomical features of the baby B such as the distance between the shoulders or the distance between the nipples of the baby. Once the girth of the shell 12 is so adjusted, the longitudinal opening 28 is closed by zipping the zipper 32 to secure the shell around the baby. When the longitudinal opening 28 is closed, the shell supplies a comforting pressure to the arms and trunk of the baby B. The length of the shell 12 may also be adjusted to correspond to a length of the trunk and legs of the baby B as explained above.

Preferably, the method of adjusting the girth of the shell 12 described above provides the body portion 60 of the shell with an unstretched circumference measured around the inner surface 16 of the shell between about fifty percent and about 75 percent of a corresponding nominal girth of the baby B measured around the trunk and arms of the baby. More preferably, the method provides the body portion 60 of the shell with an unstretched circumference of about sixty percent of the corresponding nominal girth of the baby B. Further, the leg portion 62 of the garment 10 described above has an unstretched circumference measured around the inner surface 16 of the shell greater than about 200 percent of a corresponding nominal girth of the baby B measured around the legs of the baby.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A garment for swaddling a baby, said garment comprising:

an elongate shell having an outer surface, and an inner surface opposite said outer surface defining an interior volume for receiving the arms, legs and trunk of a baby therein, said shell having a head end, a foot end opposite said head end, lateral sides extending between the head end and the foot end, and a neck opening at the head end for receiving a neck of the baby; and a pair of restraints positioned inside the interior volume of the shell adjacent the lateral sides, each of said restraints surrounding a central axis extending longitudinally with respect to the shell for receiving one of said arms of the baby to retain the respective arm within the interior volume of the shell.

2. A garment as set forth in claim 1 wherein the pair of restraints is releasably attached to the inner surface of the shell.

3. A garment as set forth in claim 2 wherein each restraint of the pair of restraints is tubular.

4. A garment as set forth in claim 1 further comprising a longitudinal opening in the shell extending from the neck opening for providing access to the interior volume of the shell to insert the baby into the interior volume and remove the baby therefrom, and a closure disposed along the longitudinal opening for selectively closing the longitudinal opening and securing the baby inside the interior volume of the shell.

5. A garment as set forth in claim 4 wherein the closure extends along a front of the garment.

6. A garment as set forth in claim 4 wherein the closure is a zipper.

7. A garment as set forth in claim 1 further comprising at least one adjustment element disposed along the shell for adjusting at least one of a size and a shape of the interior volume of the shell.

8. A garment as set forth in claim 7 wherein the adjustment element comprises at least one zipper.

9. A garment as set forth in claim 7 wherein the adjustment element comprises at least one snap fastener.

10. A garment as set forth in claim 7 wherein the adjustment element is positioned along at least one of said lateral sides of the shell.

11. A garment as set forth in claim 10 wherein the adjustment element comprises fasteners arranged in longitudinal rows along the lateral sides of the shell for adjusting a girth of the garment thereby accommodating babies of differing sizes.

12. A garment as set forth in claim 7 wherein the adjustment element is positioned at the foot end of the shell for adjusting a length of the shell thereby accommodating babies of differing lengths.

13. A garment as set forth in claim 12 wherein the adjustment element includes at least one fastener arranged to allow the foot end to be rolled and fastened to the shell between the head end and the foot end.

14. A garment as set forth in claim 1 wherein the shell comprises a stretchable material.

15. A garment as set forth in claim 14 wherein the stretchable material includes spandex fibers.

16. A garment as set forth in claim 1 wherein the shell comprises a breathable material.

17. A bag-type garment for swaddling a baby comprising an elongate shell having an outer surface, and an inner surface opposite said outer surface defining an interior volume for receiving the arms, legs and trunk of a baby therein, said shell having a head end, a foot end opposite said head end, lateral sides extending between the head end and the foot end, and a neck opening at the head end for receiving a neck of the baby, said shell including a body portion adjacent the head end sized and shaped for enclosing the arms and trunk of the baby and for holding the arms of the baby in close proximity to the trunk of the baby, and a leg portion adjacent the foot end sized and shaped for enclosing the legs of the baby with sufficient space to permit flexure and abduction of the hips of the baby within the interior volume of the garment.

18. A garment as set forth in claim 17 wherein the body portion of the shell has an unstretched circumference measured around the inner surface of the shell between about fifty percent and about 75 percent of a corresponding nominal girth of the baby measured around the trunk and arms of the baby.

19. A garment as set forth in claim 18 wherein the unstretched circumference of the body portion is about sixty percent of the corresponding nominal girth of the baby.

20. A garment as set forth in claim 17 wherein the leg portion of the shell has an unstretched circumference measured around the inner surface of the shell greater than about 200 percent of a corresponding nominal girth of the baby measured around the legs of the baby.

21. A garment as set forth in claim 17 further comprising at least one adjustment element disposed along the shell for adjusting at least one of a size and a shape of the interior volume of the shell.

22. A garment as set forth in claim 21 wherein the adjustment element is positioned along at least one of said lateral sides of the shell for adjusting a girth of the shell thereby accommodating babies of differing sizes.

23. A garment as set forth in claim 21 wherein the adjustment element is positioned at the foot end of the shell for adjusting a length of the shell thereby accommodating babies of differing lengths.

24. A garment as set forth in claim 17 further comprising a pair of restraints positioned inside the interior volume of the shell adjacent the lateral sides, each of said restraints for receiving one of said arms of the baby to retain the respective arm within the interior volume of the shell.

25. A garment for swaddling a baby comprising an elongate shell having an outer surface, and an inner surface opposite said outer surface defining an interior volume for receiving the arms, legs and trunk of a baby therein, said shell having a head end, a foot end opposite said head end, lateral sides extending between the head end and the foot end, a neck opening at the head end for receiving a neck of the baby, and a longitudinal opening extending from the neck opening for providing access to the interior volume of the shell, said longitudinal opening having an open position for inserting the baby into the interior volume and removing the baby from the volume, and a closed position for retaining the baby in the interior volume, the shell having an unstretched circumference measured around the inner surface of the shell when the longitudinal opening is in the closed position equal to between about fifty percent and about 75 percent of a corresponding nominal girth of the baby measured around the trunk and arms of the baby.

26. A garment as set forth in claim 25 wherein the unstretched circumference is about sixty percent of the corresponding nominal girth of the baby.

27. A garment for swaddling a baby comprising an elongate shell having an outer surface, and an inner surface opposite said outer surface defining an interior volume for receiving the arms, legs and trunk of a baby therein, said shell having a head end, a foot end opposite said head end, lateral sides extending between the head end and the foot end, a neck opening at the head end for receiving a neck of the baby, and a longitudinal opening extending from the neck opening for providing access to the interior volume of the shell, said longitudinal opening having an open position for inserting the baby into the interior volume and removing the baby from the volume, and a closed position for retaining the baby in the interior volume, wherein the shell applies a pressure to the baby when the longitudinal opening is in the closed position between about one half centimeter of water and about three centimeters of water.

28. A method of swaddling a baby comprising the steps of:

placing a baby in an interior volume of an elastic shell having a longitudinal opening for providing access to the interior volume of the shell;

adjusting a girth of the shell so that when the shell is wrapped taut around the baby without stretching the shell, the longitudinal opening of the shell has a width selected to apply a predetermined approximate pressure to the baby when the longitudinal opening is closed; and closing the longitudinal opening to stretch the shell around the baby and secure the shell about the baby.

29. A method as set forth in claim 28 wherein said width equals a spacing between the nipples of the baby.

30. A method as set forth in claim 28 wherein the predetermined approximate pressure is between about one half centimeter of water and about three centimeters of water.

31. A method as set forth in claim 28 further comprising the step of adjusting a length of the shell to correspond to a length of the trunk and legs of the baby.

32. A method as set forth in claim 28 further comprising the step of securing each arm of the baby in the shell to retain the respective arm in the interior volume of the shell.

33. A method of swaddling a baby comprising the steps of:

placing a baby in an interior volume of a sleeveless, tubular shell; and securing each arm of the baby to the shell to retain the respective arm in the interior volume of the shell.

* * * * *